United States Patent [19]

Hennells

[11] 3,945,314

[45] Mar. 23, 1976

[54] WASTE COMPACTOR WITH CLAMSHELL BAG SUPPORT

[75] Inventor: Ransom J. Hennells, Plymouth Township, Wayne County, Mich.

[73] Assignee: Compactor Company, Inc., Belleville, Mich.

[22] Filed: Oct. 16, 1972

[21] Appl. No.: 297,822

[52] U.S. Cl. ..... 100/53; 100/215; 100/229 A; 141/316; 141/390; 200/61.62; 220/63 R

[51] Int. Cl.[2] ..... B30B 15/16

[58] Field of Search ..... 141/316, 314, 313, 315, 141/317, 71, 73; 220/63 R, 65; 100/229 A, 215, 52, 53, 255; 232/43.1, 43.2; 53/124 B; 200/61.62

[56] References Cited

UNITED STATES PATENTS

| | | | |
|---|---|---|---|
| 8,625 | 1/1852 | Bushnell | 141/390 X |
| 35,075 | 4/1862 | Brown | 141/316 X |
| 206,977 | 8/1878 | Sands | 141/316 |
| 320,052 | 6/1885 | Dorsey | 141/316 X |
| 652,331 | 6/1900 | Rudolph | 220/63 R |
| 756,693 | 4/1904 | Parr | 141/390 |
| 1,675,669 | 7/1928 | Snyder | 100/215 X |
| 2,111,327 | 3/1938 | O'Hare | 141/390 |
| 3,353,478 | 11/1967 | Hopkins | 100/215 X |
| 3,405,744 | 10/1968 | Bowman | 141/390 X |
| 3,463,079 | 8/1969 | Corbett | 100/215 |
| 3,539,741 | 11/1970 | Voland | 200/61.62 |
| 3,589,277 | 6/1971 | Gray et al. | 100/215 |
| 3,627,959 | 12/1971 | Chapell | 200/61.62 |
| 3,691,944 | 9/1972 | Boyd | 100/229 A |
| 3,722,561 | 3/1973 | O'Leary et al. | 141/316 |
| 3,727,546 | 4/1973 | McKinney | 100/229 A |
| 3,734,006 | 5/1973 | Hennells | 100/229 A |
| 3,734,340 | 5/1973 | Ippolits | 220/63 R |
| 3,741,107 | 6/1973 | Boyd et al. | 100/215 |
| 3,756,150 | 9/1973 | Bourgeois | 100/229 A |
| 3,885,467 | 5/1975 | Merkin | 100/229 A |

OTHER PUBLICATIONS

"SECO" Pamphlet, – 4 shts., June 23, 1971.

*Primary Examiner*—Billy J. Wilhite
*Attorney, Agent, or Firm*—Woodhams, Blanchard and Flynn

[57] ABSTRACT

A waste compactor comprising a cabinet having an extendible ram assembly mounted adjacent the upper end thereof and a removable dolly associated with the lower end thereof. The dolly is adapted to support a vertically elongated support device which is adapted to be inserted into the interior of a disposable flexible bag for supporting the bag in an open and upright position for permitting trash to be deposited therein when the support device and bag is disposed on the dolly and positioned under the ram assembly. The support device also acts as a liner for protecting the bag. A chute is swingably mounted on the cabinet for permitting waste to be deposited into the bag. The chute is movable into a closed position wherein it substantially closes the front wall of the cabinet and, when in the closed position, coacts with a safety device to permit energization of the ram assembly. The safety device prevents actuation of the ram assembly when the chute is open or when the dolly is removed from the cabinet.

11 Claims, 12 Drawing Figures

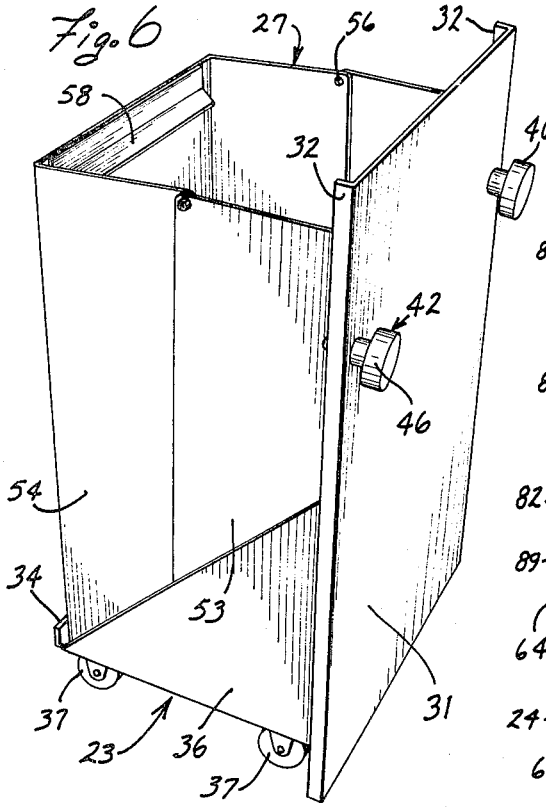
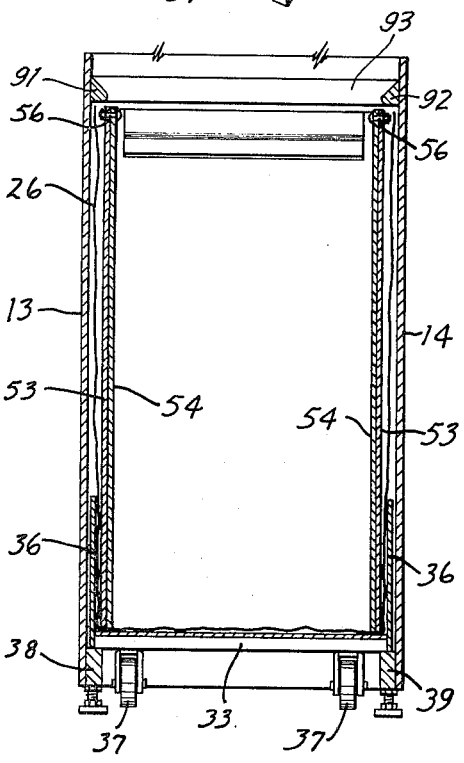
Fig. 5
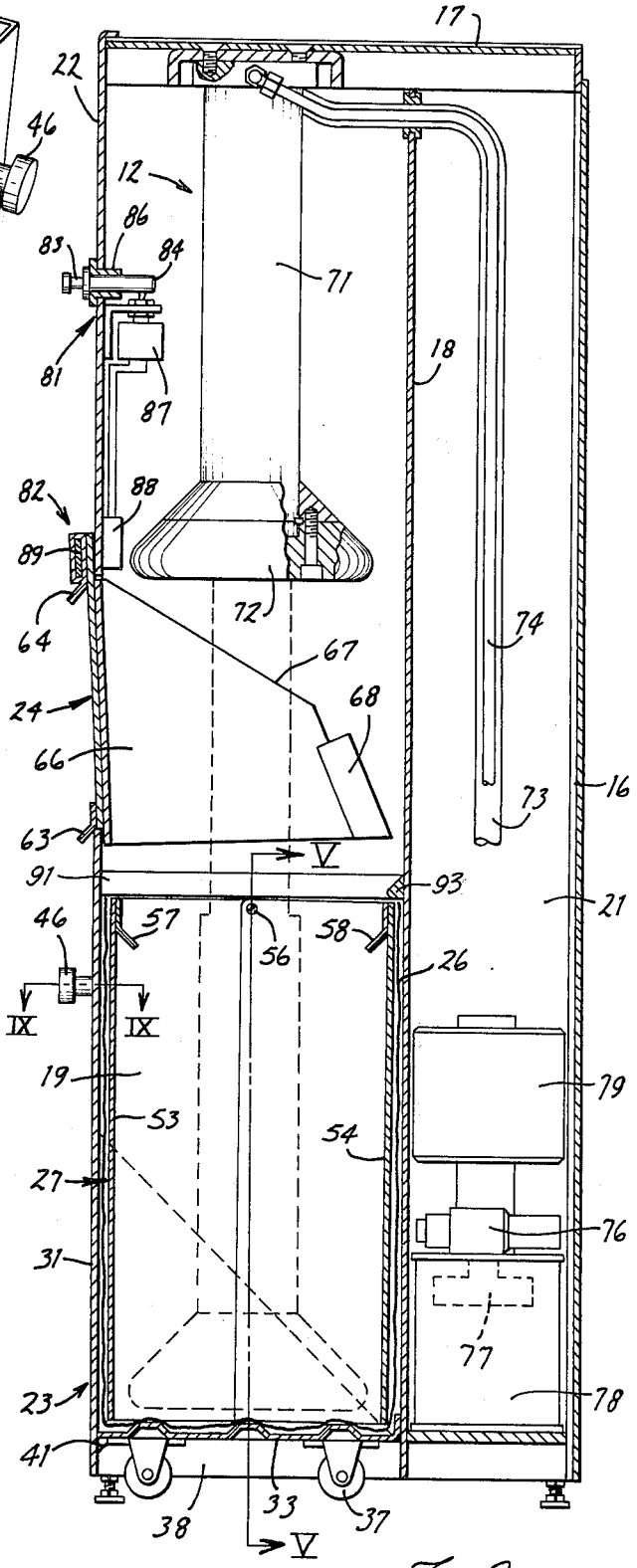
Fig. 3

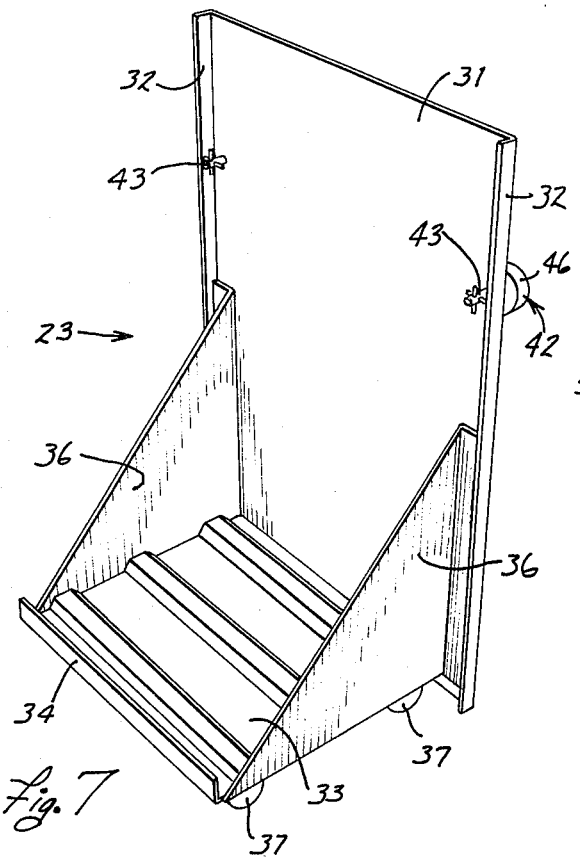
Fig. 7
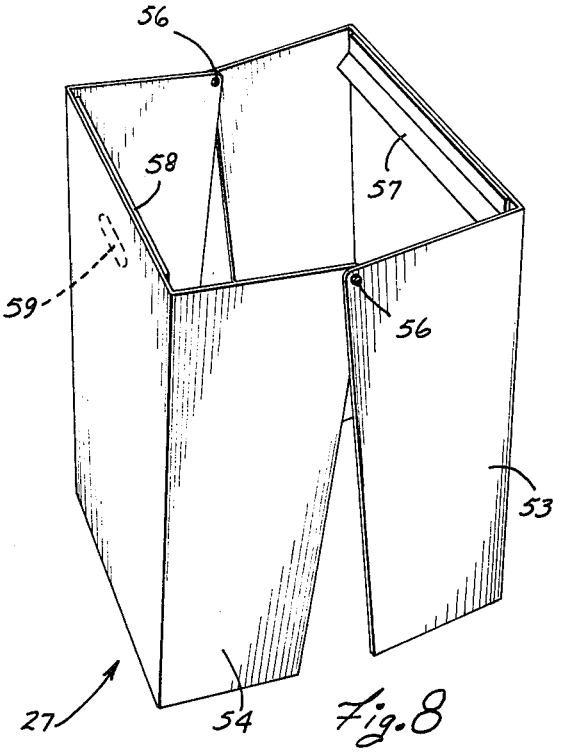
Fig. 8
Fig. 10
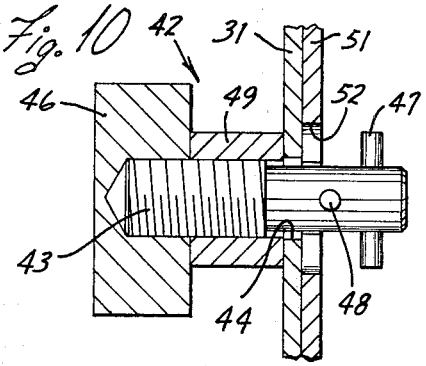
Fig. 9
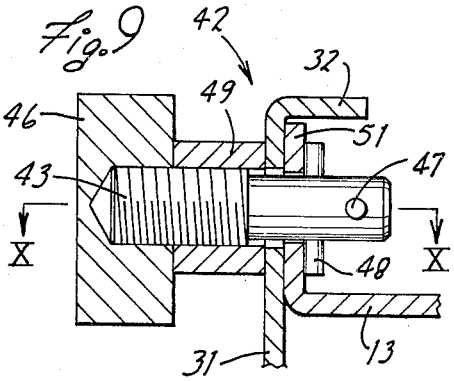
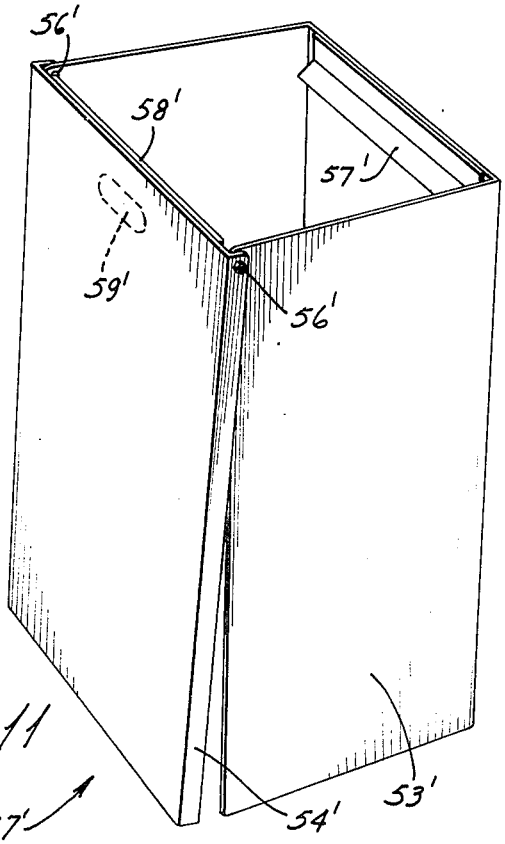
Fig. 11

WASTE COMPACTOR WITH CLAMSHELL BAG SUPPORT

CROSS REFERENCE TO RELATED APPLICATION

This application is related to my copending application Serial No. 297,823, filed concurrently herewith now U.S. Pat. No. 3,827,348.

1. Field of the Invention

This invention relates to a waste disposal device for compacting paper and related compressible products and, in particular, relates to an improved waste compacting device which is of compact size and provides maximum operator safety.

2. Background of the Invention

My above-mentioned copending application Ser. No. 297,823 now U.S. Pat. No. 3,827,348 discloses therein a waste compacting device which is of compact size and provides maximum operator safety. In this prior compacting device, the flexible disposable bag is supported on a ring which is removably positioned within the cabinet in alignment under the ram assembly for permitting trash to be compacted within the bag. When the bag is full, the ring is slid from the cabinet to permit securing of the bag, with the filled bag then being manually removed to a suitable location and a new empty bag is again mounted on the ring. While this waste compactor has proved highly successful and desirable, both in terms of safety, efficiency and mode of operation, nevertheless it has been discovered that in some situations the necessity of having to pull or carry the bag filled with compacted trash can be difficult and unduly time consuming, and thus in some situations there exists a need for a structure which permits a more efficient disposal of the filled bags without requiring carrying of same.

Accordingly, the present invention relates to an improved waste compacting device similar to the device disclosed in my above-mentioned application, but wherein the device incorporates still further improvements to make the device more adaptable for use in various use situations, and so as to still further simplify the overall handling and manipulation of the filled bags of trash.

Thus, it is an object of the present invention to provide an improved waste compacting device which incorporates all of the advantages of my prior device, and which includes still further improvements and advantages to facilitate the compacting of the trash and the handling and the manipulation of the filled bags.

Particularly, it is an object of the present invention to provide an improved waste compacting device, as aforesaid, which incorporates therein a dolly structure which is useable for supporting the bag during the filling and compacting of the trash therein with the dolly being separable from the compactor housing to enable the filled bag of trash to be easily transported to a different location without requiring lifting or manual manipulation of the filled bag.

Another object of the present invention is to provide an improved compactor, as aforesaid, which includes an improved support device for the flexible disposable bag, which support device functions both for supporting the empty bag in an upright position to facilitate filling of same and for protecting the bag from tearing and ripping when the trash is being compacted therein.

Still another object of the present invention is to provide an improved compactor, as aforesaid, wherein the support device comprises a pair of members pivotally connected adjacent their upper edges to form a clamshell-like device, which device can be easily inserted into the interior of an empty bag and is effective for supporting the empty bag in an upright position when positioned on the dolly, with the clamshell-like device also functioning as a liner for protecting the bag during the compacting of the trash therein.

A further object of the present invention is to provide an improved compactor, as aforesaid, wherein the support device is of lightweight to facilitate its insertion into and removal from the bag, and wherein the clamshell construction of the support device permits the device to assume a downwardly diverging tapered shape when the bag is filled with trash to facilitate the removal of same from the filled bag.

Other objects and purposes of the present invention will be apparent to persons acquainted with devices of this type upon reading the following specification and inspecting the accompanying drawings.

BRIEF DESCRIPTION OF THE DRAWINGS

FIG. 3 is a side, central sectional view of the compacting device, same being illustrated in its closed position and with the ram in its upwardly retracted position.

FIG. 5 is a fragmentary sectional view taken substantially along the line V—V of FIG. 3.

FIG. 6 is a perspective view of the dolly structure with the bag support device mounted thereon.

FIG. 7 is a further perspective view of the dolly structure but with the bag support device removed.

FIG. 8 is a perspective view of the improved bag support device.

FIG. 9 is an enlarged sectional view take substantially along the line IX—IX of FIG. 3.

FIG. 10 is a sectional view taken along substantially the line X—X of FIG. 9.

FIG. 11 is a perspective view of a modified bag support device.

Figure 1:
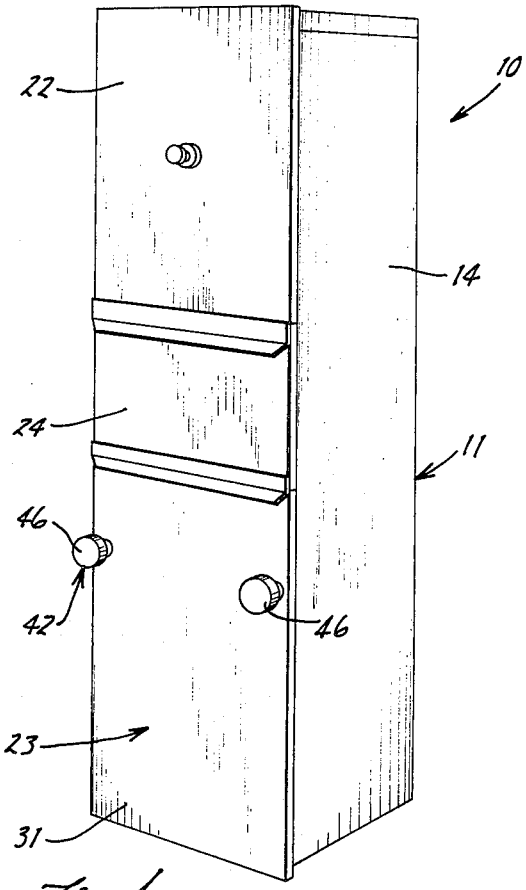
FIG. 1 is a perspective view of the improved compacting device constructed according to the present invention, same being illustrated in the closed position.

Certain terminology will be used in the following description for convenience in reference only and will not be limiting. For example, the words "rightwardly", "leftwardly", "upwardly" and "downwardly" will refer to directions in the drawings to which reference is made. The word "front" will refer to the front side of the machine, same being the left side as appearing in FIGS. 3 and 4, with the word "rear" being used to refer to the back side of the machine as appearing on the right side of FIGS. 3 and 4. The words "inwardly" and "outwardly" will refer to the geometrical center of the machine and to designated parts thereof. Said terminology will include the words above specifically mentioned, derivatives thereof and words of similar import.

SUMMARY OF THE INVENTION

The objects and purposes of the present invention are met by providing a waste compactor comprising a cabinet having a fluid pressure-operated extendible ram assembly mounted adjacent the upper end thereof and having a removable dolly assembly adjacent the lower end thereof for supporting a disposable bag under the ram assembly. The bag is supported on the dolly by a support device which includes a pair of opposed members which are pivotally connected at their adjacent upper edges to form a clamshell-like structure. The support device is positionable in the interior of the bag with the friction between the device and the bag being sufficient to support the bag in an open upright position under the ram assembly. The support device, which is freestanding on the dolly and resembles a vertically elongated tubular structure, also functions as a liner for protecting the bag. A chute is swingably mounted on the cabinet and disposed directly above the dolly for permitting waste to be deposited into the bag. The chute and the dolly substantially close the front wall of the cabinet. The chute, coacts with a safety interlock device which permits energization of the ram assembly only when the chute is closed. The chute is totally removable from the cabinet to permit the dolly and the filled bag mounted thereon to be rollingly removed from the cabinet.

DETAILED DESCRIPTION

FIG. 1 illustrates a waste compactor 10 constructed according to the present invention, which compactor includes a substantially box-like housing 11 containing therein a ram assembly 12 (FIG. 3) for permitting waste to be compacted within a disposable receptacle, such as a flexible plastic bag.

The housing 11 includes a pair of opposed and substantially parallel sidewalls 13 and 14 fixedly interconnected by a back wall 16 and a top wall 17. An intermediate partition 18 is disposed within the housing and extends thereacross in substantially parallel relationship with the back wall 16 and divides the housing into a front trash receiving compartment 19, in which is positioned the ram assembly 12, and a rear equipment compartment 21.

Figure 4:
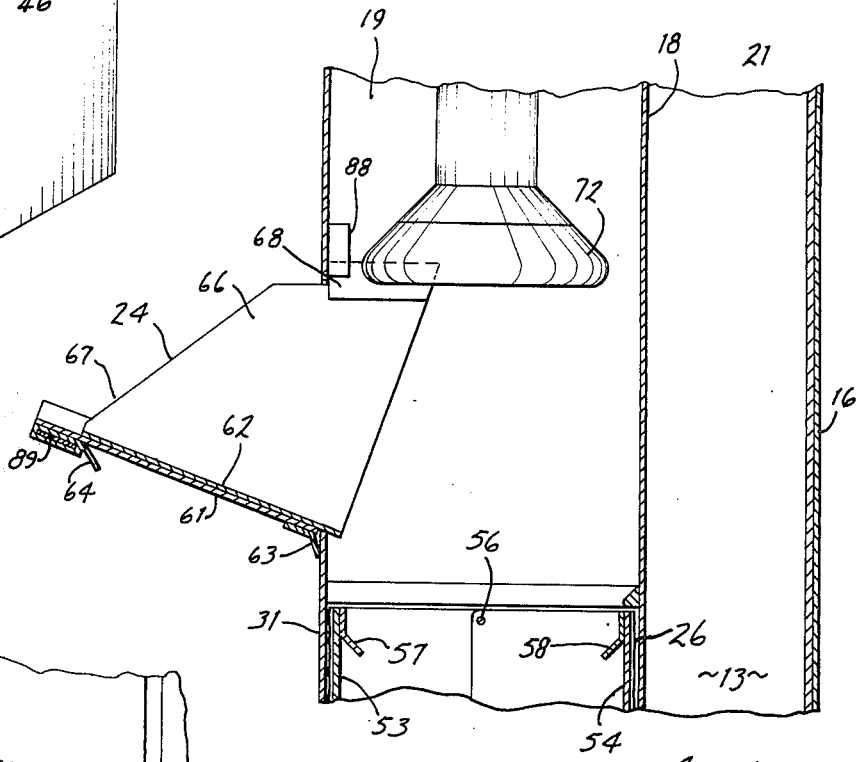
FIG. 4 is a fragmentary, side sectional view similar to FIG. 3 and illustrating the loading chute in its open position.
Figure 2:
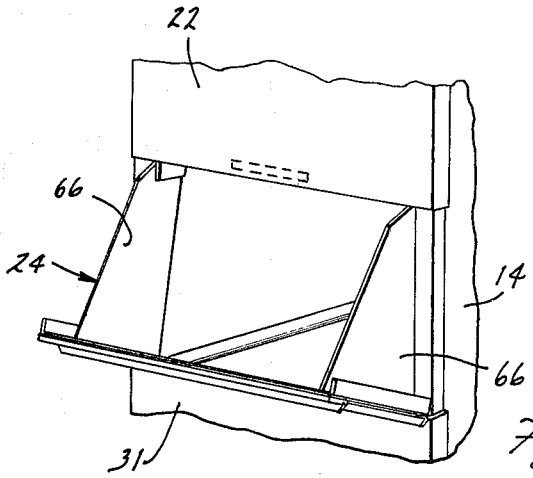
FIG. 2 is a fragmentary, perspective view of a portion of a compacting device and illustrating the loading chute in its open position.

The upper portion of the front side of the housing 11 is closed by means of a removable upper panel 22. The lower front side of the housing is closed by means of a panel 31 which comprises a portion of a removable dolly 23. A removable loading chute 24 is disposed between the panel 22 and the dolly 23 for enabling waste to be loaded into the device. The chute 24, when in the closed position illustrated in FIGS. 1 and 3, results in the front side of the housing 11 being totally closed. However, the chute 24 is swingably movable into an open position, as illustrated in FIGS. 2 and 4, to enable trash to be deposited through the device. To receive the trash which is deposited through the chute 24 into the device, the dolly 23 is adapted to have a flexible bag 26 supported thereon, which bag is supported in an open upright position on the dolly by means of a removable support device 27.

Considering first the dolly 23, the front panel 31 thereof is provided with substantially perpendicular flanges 32 extending along the opposite vertical edges thereof, which flanges are designed to overlap the adjacent front edges of the housing sidewalls 13 and 14. The dolly further includes a floor 33 which, in the illustrated embodiment, is of a corrugated construction to increase the strength and rigidity of same. The floor 33 preferably has the forward edge thereof upturned to form a flange 34. The floor 33 and front panel 31 are additionally fixedly interconnected by a pair of spaced and substantially parallel angle plates 36 which are disposed adjacent the opposite sides of the dolly.

The dolly 23 is further provided with a plurality of rollers of casters 37 thereon to permit same to be rollingly moved about on a suitable support surface, such as on the floor or on the ground. When the dolly is disposed within the housing 11, the floor 33 of the dolly is supported upon a pair of elongated guide rails 38 and 39 which are fixedly secured to the lower inner ends of the housing sidewalls 13 and 14, respectively. The guide rails 38 and 39 are suitably vertically spaced above the floor so as to assume the weight of the dolly 23, whereby the rollers 37 are thus maintained out of engagement with the supporting floor or surface. To facilitate movement of the dolly 23 onto the guide rails 38 and 39, the guide rails are preferably provided with inclined cam rams 41 (FIG. 3) on their forward ends. Further, the guide rails 38 and 39 are preferably provided with a strip of low friction material, such as nylon, on their upper surface to facilitate the free sliding movement of the dolly into and out of the housing.

The dolly 23 is fixedly connected to the housing 11 by a pair of releasable locking devices 42, which locking devices are disposed on opposite sides of the dolly in a position for locking engagement with the opposite sidewalls 13 and 14. Each locking device 42 includes a shaft 43 (FIGS. 9 and 10) which is rotatably supported in an opening 44 formed in the front panel 31. The outer end of the shaft 43 is threaded and has a control knob 46 adjustably but fixedly secured thereto. The inner end of the shaft 43 has a pair of radially extending pins 47 and 48 fixedly secured thereto, which pin are axially spaced from one another and are also angularly offset from one another by a substantial angle, particularly by an angle of approximately 90° in the illustrated embodiment. The locking device further includes an adjustable nut 49 threaded on the shaft 43 for permitting the knob 46 of the locking device to be suitably adjusted to enable the dolly 23 to be locked to the housing 11 with the desired degree of tightness. To enable the locking devices to coact with the sidewalls of the housing, each sidewall 13 and 14 of the housing is provided with a sidewardly projecting flange 51 containing a vertically elongated slot 52 therein, which slot is designed to enable the pins 47 and 48 to be slidably moved therethrough. Further, the pins 47 and 48 are axially spaced from one another by a sufficient distance to accommodate the thickness of the flange 51 and the front panel 31 therebetween so that the pin 47 is initially axially inserted into the elongated slot 52, with the shaft 42 then being rotated approximately 90° so that the pin 47 extends transversely of the slot, while the pin 48 is aligned with the slot. The shaft 43 is then pushed axially inwardly a further amount to cause the pin 48 to pass through the slot 52, whereupon the shaft 43 is then again rotated through an angle of approximately 90° to cause the pin 48 to extend transversely of the slot, thereby fixedly interconnecting the dolly to the housing.

Considering now the support device 27, same includes (in the embodiment of FIG. 8) a pair of substantially identical elongated channel-like elements 53 and 54, which elements are disposed in opposed relationship to one another so that they form a substantially vertically elongated and upwardly extending tubelike structure having a substantially square or rectangular cross section. The elements 53 and 54 are substantially identical except that the element 53 is slightly wider than the element 54 so that the elements 53 and 54 can be slidably telescopically received one within the other. The elements 53 and 54 have their upper adjacent corners pivotally interconnected by a pivot pin or rivet 56, which rivet 56 permits the elements 53 and 54 to be swung outwardly away from one another substantially as illustrated in FIG. 8. Alternately, the lower ends of the elements 53 and 54 can be pivotally swung inwardly toward one another so that they substantially overlap, whereupon the opposed sides of the support device 27 converge in the downwardly extending direction.

Figure 12:
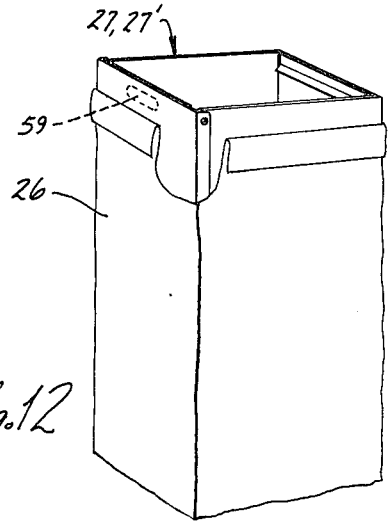
FIG. 12 is a perspective view of the bag support device having a bag positioned thereon.

The support device 27 preferably has the channel-like elements 53 and 54 constructed from a light sheet-like metal, such as steel or aluminum, whereupon the device is relatively durable but of light weight. The device 27 is adapted to be disposed in the interior of the empty bag 26, whereupon the friction which exists between the exterior walls of the device 27 and the interior wall of the bag 26 results in the bag 26 being maintained in an open upright condition in surrounding relationship to the device 27 as illustrated in FIG. 12. Further, the device 27 with the bag surrounding same is adapted to be positioned on the floor 33 of the dolly 23, the device 27 being self-supporting on the floor of the dolly for maintaining the bag in an open and upright position.

To facilitate the handling of the support device 27, one or both of the channel-like elements 53 and 54 are provided with elongated angle members 57 and 58, respectively, fixedly secured thereto and extending longitudinally along the upper edges thereof. The angle members 57 and 58 function as handles to permit insertion or removal of the device relative to the bag. The angle members 57 and 58 also effectively function as deflectors for causing the deposited trash to be deflected toward the center of the bag. Alternately, the handles 57 and 58 can be eliminated and replaced by elongated hand openings 59 for permitting gripping of the device 27.

FIG. 11 illustrates therein a modified support device 27' which is substantially similar to the support device 27 illustrated in FIG. 8 in that it again comprises a clamshell-like structure formed by two vertically elongated elements 53' and 54' which have their upper adjacent ends pivotally interconnected by means of pivot pins or rivets 56'. However, in this embodiment, the one element 53' is formed as a deep channel-shaped element having leg portions which define the complete width or thickness of the support device 27'. On the other hand, the other element 54' comprises a shallow channel-shaped element wherein a flat sheet-like member is formed with small flanges or tabs on the opposed edges thereof, which flanges enable the two elements 53' and 54' to be pivotally interconnected. The flanges preferably overlap the free edges of the sidewalls of the element 53' so that when the elements 53' and 54' are pivotally swung inwardly into their closed position, the support device 27' has a substantially uniform cross section throughout the complete length thereof. Support device 27' thus has an opening extending vertically throughout the length thereof, which opening is of a substantially rectangular configuration and is of a substantially uniform size throughout the complete length of the support device.

Considering the loading chute 24, same includes a front wall structure which comprises a pair of superimposed front plates 61 and 62 which are fixedly connected together. The frontmost plate 61 has a flange 63 fixedly secured along the lower front edge thereof which flange 63 projects outwardly and downwardly. Further, the rearmost plate 62, as illustrated in FIGS. 3 and 4, projects downwardly beyond the lower edge of the plate 61 whereupon the front flange 63 and the lower edge of the rearmost plate 62 define a space therebetween into which extends the upper edge of the front panel 31 of the dolly 23. This structure effectively acts as a hinge to enable the chute 24 to be swingably moved between the open and closed positions illustrated in FIGS. 3 and 4, respectively.

The chute 24 also has a further flange 64 secured to the front side of the plate 61 adjacent the uppermost edge thereof. Flange 64 extends outwardly and downwardly and functions as a handle to enable manual gripping of the chute 24 for permitting swinging of same between its open and closed position. As illustrated in FIG. 3, the upper edge of the flange 64 and the uppermost edge of the plate 61 are designed to overlap the lowermost edge of the upper panel 22 when the chute is in its closed position. The purpose of this structure will be explained hereinafter.

To assist in guiding the deposited trash into the bag 26, the chute 24 includes a pair of substantially parallel and identical side plates 66 positioned internally of and directly adjacent the opposite sidewalls 13 and 14. The side plates 66 each include a tapered upper edge 67 which enables the chute 24 to be freely pivotally swung between its open and closed position. The tapered edge 67 also enables the chute 24, after same has been swung a small distance away from its closed position, to be vertically lifted upwardly to clear the upper edge of the panel 31, whereupon the chute 24 can be totally disconnected and removed from the housing 11. Each sidewall 66 also has a shoulder 68 formed on the rearward edge thereof which functions as a stop member and engages the lower inner edge of the upper panel 22 for maintaining the chute in its open position. In the open position, the front plates 61 and 62 project outwardly and upwardly relative to the housing to thus enable trash to be deposited thereon, whereupon the trash slides inwardly into the housing so as to be deposited into the interior of the support device 27, which device in turn is surrounded by the bag 26.

To further assist in guiding the trash into the bag 26, the housing has rails 91 and 92 (FIG. 5) fixed on the inner surfaces of the opposite sidewalls 13 and 14, and a further rail 93 is fixed to the interior partition 18. These rails 91, 92 and 93 extend substantially horizontally, and the rear rail 93 extends between the rearward ends of the side rails 91 and 92. Each of these rails has an upper surface thereon which slopes inwardly and downwardly. These rails project inwardly of the housing so as to substantially overlap the upper end of the waste receiving receptacle formed by the bag 26 and the support device 27, so that the waste thus falls into the bag and does not pass along the outside thereof. These rails also assist in holding the waste receiving receptacle on the dolly since the rails, by being positioned closely adjacent the upper edge of the support device 27, prevent any substantial upward movement of the support device, such as might occur due to the expansion of waste when the compaction pressure is relieved.

The ram assembly 12, as illustrated in FIG. 3, is disposed adjacent the upper end of the compartment 19 and is substantially coaxially aligned with the longitudinal axis of the support device 27 when the support device is mounted on the dolly and the dolly is locked within the housing. Thus, energization and extension of the ram assembly causes the ram to extend downwardly into the interior of the support device 27 and into the interior of the surrounding bag 26 for compacting the waste therein. The ram assembly 12 includes a fluid pressure cylinder 71 which is preferably a telescopic, double-acting, hydraulic cylinder having the upper end thereof fixedly secured to the top wall 17 and having a compacting shoe 72 on the lower end thereof. The construction of the fluid cylinder 71 is explained in greater detail in my copending application Ser. No. 874,940, filed Nov. 7, 1969 now U.S. Pat. No. 3,734,006.

Pressure fluid is supplied to and from the cylinder 71 by conduits 73 and 74 which are connected to a conventional solenoidoperated four-way valve 76. The four-way valve 76 is connected to a power unit which, as illustrated in FIG. 3, includes a conventional rotary pump 77 disposed within an oil reservoir 78 and driven by a conventional electric motor 79. The valve 76 has a conventional pressure switch (not shown) associated therewith for causing the valve to be automatically shifted upon attainment of a predetermined pressure to thus cause automatic reversal in the direction of travel of the compacting ram.

The compactor 10 of the present invention also includes a control system associated therewith, which control system includes actuator means 81 for permitting actuation of the power unit for causing activation of the ram assembly and also includes safety interlock means 82 for positively preventing activation of the ram assembly except when the chute is in its closed position.

The actuator means 81 includes an enlarged actuator knob 83 disposed externally of the upper panel 22. The actuator knob 83 is fixedly secured to the forward end of an elongated control rod 84, which rod extends through an opening formed in the panel 22 and is axially slidably supported on a bearing sleeve 86 fixedly secured to the inner side of the panel 22. The rearward end of the control rod 84 is positioned in engagement with the actuator lever of a conventional on-off electrical switch 87. The switch 87 is a conventional three-position switch which is electrically interconnected to the motor 79 for controlling energization thereof.

To insure that the actuator means cannot be activated to cause energization of the ram assembly when the chute is in its open position, the compactor 10 is additionally provided with the safety interlock means 82 associated therewith. The safety means 82 includes a conventional magnetically actuated switch 88 which is mounted adjacent the inside surface of the panel 22 adjacent the lower edge thereof, substantially as illustrated in FIGS. 3 and 4. To permit actuation of the magnetic switch 88, a conventional permanent magnet 89 is secured to the upper edge of the chute 24, such as by being positioned between the plate 61 and the flange 64. The switch 88, in one embodiment of the invention, may be connected in series with the relay which is used for energizing the motor 79. Thus, so long as the switch 88 remains in an open position, such as whenever the chute is open or removed from the housing, then the motor 79 cannot be activated irrespective of the position of the on-off actuator switch 87. However, when the chute is closed, magnet 89 causes closure of switch 88 so that the motor can then be energized by actuation of the actuator switch 87.

OPERATION

The operation of the compactor constructed according to the present invention will be briefly described to insure a complete understanding thereof.

It will first be assumed that the compactor 10 is in an inoperative position wherein the chute 24 is disconnected from the housing 11 and the dolly 23 is also removed from the housing. To ready the compactor 10 for use, the support device 27 or 27′ is inserted into the interior of a flexible bag 26 and the sidewall of the bag is pulled upwardly in surrounding relationship to the device (see FIG. 12). The support device 27 or 27′ with the bag 26 surrounding same is then positoned on the floor 33 of the dolly 23, the free ends of the elements 53 and 54 being confined between the front panel 31 and the upturned flange 34 substantially as illustrated in FIG. 6. The friction which exists between the bag 26 and the support device 27 and 27′ maintains the bag in an upright condition in surrounding relationship to the support device.

The dolly 23 is then wheeled into a position directly in front of the housing 11, the dolly being pushed into the housing so that the floor of the dolly is cammed upwardly by the rams 41 so that the floor of the dolly is slidably supported on the guide rails 38 and 39. The dolly is slidably inserted into the housing until the flange 34 substantially abuts the intermediate partition 18. With the dolly 23 fully inserted into the housing substantially as illustrated in FIG. 3, the locking devices 42 are then suitably manipulated substantially as explained above, so as to fixedly lock the opposite sides of the dolly to the opposed sidewalls 13 and 14. The dolly is thus fixedly secured to the lower portion of the housing 11 with the support device 27 or 27′ and surrounding bag 26 being disposed within the housing in substantial alignment with and beneath the ram assembly 12.

The chute 24 is then mounted on the housing 11 by inserting the side plate 66 between the sidewalls 13 and 14 and by positioning the chute so that the upper edge of the front panel of the dolly 23 extends into the opening between the flange 63 and the lower edge of the front plate 62. The chute is then swung outwardly so that the stops or shoulders 68 engage the lower edge of the upper panel 22, thereby placing the chute in the open position illustrated in FIGS. 2 and 4. The compactor 10 is thus in condition to enable trash and waste to be deposited therein.

The waste which is deposited into the chute 24 slides downwardly and inwardly along the chute so as to fall into the interior of the tubular support device 27 or 27′, which device is surrounded by the bag 26. After a sufficient amount of waste has been deposited into the device 27 or 27′ so as to loosely fill same, then the chute 24 is manually swung inwardly to its closed position as illustrated in FIG. 3, whereupon the upper edge of the chute overlaps the lower edge of the panel 22. In this overlapped position, the chute is maintained in its closed position by the magnet 89. The magnet 89 also causes the switch 88 to be magnetically actuated and moved to its closed position, thereby deactivating the safety means. The operator can then pull the actuator knob 83 axially outwardly, which thus causes closure of switch 87 and energization of a relay to thus actuate the motor 79. This causes rotation of the pump 77 so that pressure fluid is supplied through the valve 76 to the pressure cylinder 71 to cause extension of the ram assembly 12. The pressure fluid supplied to the pressure cylinder 71 causes the shoe 72 to be moved downwardly as illustrated by dotted lines in FIG. 3 to cause the waste to be compacted within the support device 27. The device 27 or 27' also functions as a liner and protects the sidewall of the bag 26 to prevent tearing or ripping of the sidewall by the waste which is being compacted. The compacting force as imposed on the waste by the ram is transmitted onto the floor 33 of the dolly, which force is then transmitted onto the rails 38 and 39 of the housing 11. The compacting forces are thus not imposed upon the supporting surface of the floor. When a predetermined pressure is developed within the cylinder 71, irrespective of the extension of the ram, then the valve 76 is automatically shifted by the pressure switch (not shown) to cause pressure fluid to be supplied to the lower end of the cylinder 71 so that the ram assembly is then retracted upwardly into its original position as illustrated by solid lines in FIG. 3. The motor 79 will then be de-energized by a further pressure switch when the ram is fully retracted.

After the ram assembly has been de-energized, the operator can then manually grip the handle or flange 64 and swing the chute 24 into its open position to permit further waste or trash to be deposited into the bag. The opening of the chute 24 again causes the magnetic switch 88 to return to its normally open position, thereby preventing energization of the motor-pump unit and of the ram assembly irrespective of the position of the actuator switch 87. Further, if the operator should inadvertently attempt to open the chute 24 when the ram assembly is energized, the initial opening movement of the chute 24 will result in the magnetic switch 88 being immediately returned to its normally opened position, which thus completely de-energizes the electrical system and completely de-energizes the motor and the ram assembly so that the ram assembly will be immediately stopped in whatever position that it occupies at that time. This thus prevents the operator from depositing trash into the compactor while the ram assembly is energized and thus provides for optimum operator safety.

After sufficient waste has been deposited and compacted within the support device 27 or 27' so as to substantially fill same, which quantity of waste is also sufficient to substantially fill the surrounding bag 26, and assuming that the chute 24 is in the open position as illustrated in FIG. 4, the operator will then swing the chute 24 toward its closed position. However, the chute will not be fully closed but rather will be swung between its fully open and fully closed position, whereupon the operator will then manually grasp the chute and lift same vertically (as permitted by the tapered edges 67) a sufficient extent to enable the rearmost front plate 62 to be disposed above the upper edge of the dolly panel 31. When this position is reached, then the complete chute 24 can be manually withdrawn and disconnected from the compactor 10. The operator will then manually unlock the locking devices 42 and, by using same as handles, will manually slide the dolly 23 outwardly from the housing 10 until the dolly 23 rests on its rollers 37. With the dolly 23 completely removed from the housing 11 and resting on its own rollers 37, then the operator will manually grasp the device 27 or 27', either by handles 57–58 or by hand openings 59, and vertically lift the support device upwardly a slight distance from the floor 33 of the dolly 23. After the support device 27 or 27' has been lifted by a sufficient extent to clear the upper edge of the upturned flange 34, then the waste as compacted within the support device will tend to expand, thereby causing the lower ends of the elements 53–54 or 53'–54' to pivotally swing outwardly away from one another about the pivot axis defined by the rivets 56. The support device 27 or 27' as disposed within the bag 26 will thus assume a somewhat tapered configuration with the taper diverging in a downward direction, the amount of taper being dependent upon the surrounding bag 26 and the amount of expansion imposed on the support device by the waste compacted therein. This slight downward divergent configuration of the support device 27 or 27' facilitates the complete removal of the support device from the bag 26, which removal can be easily completed merely by pulling the support device straight upwardly so as to cause same to be completely withdrawn from the bag 26. The compacted waste is thus left in the bag 26 whereupon the free edge of the bag can then be suitably secured, as by means of a flexible tie. Since the disposable bag 26 containing the compacted waste therein is still seated on the dolly 23, the dolly can then be suitably rolled to any remote location to permit storage or disposal of the filled bag.

After the filled bag has been removed from the dolly, then the support device 27 or 27' is again inserted into an empty bag and the support device and empty bag are then positioned on the dolly. The dolly is then repositioned in the housing in substantially the same manner as described above so as to permit further utilization of the compactor.

For positioning a bag 26 on the support device 27 or 27', it is preferrable to position the device in an inverted freestanding manner on a suitable support surface, such as on a table or on the floor. The operator thus has both hands free so as to manipulate the bag to slip it over the inverted support device. After the bag as been slipped over the support device, then the free edge of the bag is preferrably folded over into an overlapping position as illustrated in FIG. 12.

The compactor of the present invention thus permits the bags to be supported on a removable dolly to facilitate the removal of the filled bags without requiring lifting of same. Further, the device utilizes a light weight removable support device which is effective in maintaining the bag in an upright open position to facilitate the depositing of waste therein, while at the same time the support device effectively functions as a liner to protect the bag during the compacting of the waste. Still further, the compactor provides for the complete safety of the operating personnel by positively preventing energization of the ram assembly whenever the compactor is in its open position.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A waste compactor for permitting the depositing and compacting of waste within a flexible bag, comprising:

housing means;

extendible ram means mounted on and positioned adjacent the upper end of said housing means, said ram means being movable downwardly for permitting compacting of waste;

removable dolly means coacting with the lower end of said housing means and including bottom wall means positionable directly beneath said ram means when said dolly means is in a first position permitting compacting of waste, said dolly means having support roller means thereon and being movable outwardly relative to said housing means to a second position wherein said dolly means is laterally spaced from said ram means, said dolly means when in said second position permitting a flexible bag to be mounted thereon or removed therefrom;

support means removably positioned and supported on said bottom wall means of said dolly means in a free-standing manner for supporting a flexible bag in an open upright position to permit waste to be deposited and compacted therein, said support means comprising an elongated tubelike assembly of substantially rectangular cross section and having an unobstructed vertical opening extending therethrough, said tubelike assembly being positioned in the interior of said bag for maintaining said bag in an open upright condition in surrounding relationship to said tubelike assembly, said tubelike means and said surrounding bag being supported on said bottom wall means and disposed beneath said ram assembly when said dolly means is in said first position;

said tubelike assembly being of a clamshell-like construction and including a pair of vertically extending elements positioned in opposed relationship to one another so as to define said vertical opening therebetween, at least one of said elements having a channel-shaped cross section, and means hingedly interconnecting said pair of elements adjacent the upper ends thereof for enabling the lower ends of said elements to be vertically pivotally swung toward and away from one another; and said dolly means including stop means fixed thereon for overlapping the lower free ends of said elements when the tubelike assembly is positioned on the bottom wall means for preventing said elements from swinging outwardly away from one another when waste is being compacted in the interior thereof by said ram means.

2. A waste compactor according to claim 1, wherein said pair of elements are both of channel-shaped cross section and are disposed in opposed relationship to one another.

3. A waste compactor according to claim 1, further including chute means swingably mounted on said housing means at an elevation between the upper and lower ends thereof for permitting waste to be deposited into said tubelike assembly when said dolly means is disposed in said first position, said chute means being swingable between a substantially closed position wherein same is disposed substantially coextensive with the front side of said housing means and an open position wherein same projects outwardly and upwardly from the front side of said housing means for permitting waste to be deposited in said assembly; and said dolly means including a front wall portion fixedly secured to the front edge of said bottom wall means and extending upwardly therefrom, said front wall portion of said dolly means being normally disposed substantially flush with the front side of said housing means for at least closing the lower part of the front side thereof when said dolly means is in said first position, said front wall portion being disposed directly below said chute means.

4. A waste compactor according to claim 3, further including power means operatively interconnected to said ram means for supplying pressure fluid thereto to cause actuation thereof, and control means for permitting extension of said ram means only when said chute means is in its closed position;

said control means including switch means operatively connected to said power means for controlling activation thereof, said switch means being movable between a first position wherein said power means is deactivated and a second position permitting activation of said power means;

said control means further including safety means preventing activation of said power means whenever said chute means is spaced from its closed position irrespective of the position of said switch means.

5. A waste compactor according to claim 4, wherein said safety means includes a magnet mounted on said chute means and a magnetic switch device mounted on said housing means and disposed for coaction with said chute means for overriding said switch means whenever said chute means is spaced from said closed position, said magnetic switch device being normally maintained in a first position preventing actuation of said power means whenever said chute means is spaced from said closed position movement of said chute means to said closed position causing said magnetic switch device to be moved to a second position for permitting activation of said power means whenever said switch means is moved to its second position.

6. A waste compactor according to claim 3, wherein said chute means has support means associated therewith for hingedly but removably supporting said chute means on the upper edge of the front wall portion of said dolly means, said chute means being totally disconnectible and removable from said housing means and said dolly means.

7. A waste compactor according to claim 1, wherein said dolly means has a plurality of said support roller means mounted thereon and disposed for rolling engagement with a support surface, such as a floor, for permitting said dolly means to be rollingly moved about, said roller means permitting the dolly means to be rollingly moved about in a free-standing and selfsupporting manner;

said housing means including support rail means fixed to said housing means adjacent the lower end thereof and disposed for engaging and supporting said dolly means when same is in said first position, whereby loads imposed on said dolly means due to downward extension of said ram means are transmitted directly to said housing means.

8. A waste compactor according to claim 7, wherein said dolly means includes a front wall portion fixedly secured to said bottom wall means adjacent the front edge thereof and extending upwardly therefrom, said front wall portion of said dolly means being normally disposed substantially flush with the front side of said housing means for at least partially closing the lower part of the front side of said housing means when said dolly means is in said first position and said stop means including a short flange fixed to and projecting vertically upwardly from the bottom wall means adjacent the rear edge thereof.

9. A waste compactor according to claim 1, wherein said tubelike assembly consists solely of said pair of vertically extending elements, each of said elements having a channel-shaped cross section.

10. A waste compactor according to claim 1, wherein said dolly means includes a front wall portion fixedly secured to the front edge of said bottom wall means and extending upwardly therefrom, said front wall portion being normally disposed substantially flush with the front side of said housing means for at least closing the lower part of the front side thereof when said dolly means is in said first position; said stop means including a vertically extending flange fixed to said bottom wall means and projecting upwardly from the rear edge thereof so that said flange is substantially parallel with said front wall portion, said flange projecting upwardly through only a small vertical distance relative to said front wall portion;

said dolly means further including a pair of partial sidewall portions extending from the opposite edges of said front wall portion and being interconnected to the opposite side edges of said bottom wall means, said sidewall portions extending vertically upwardly from said bottom wall through a small distance relative to the height of said front wall portion;

said roller means as mounted on said dolly means including a pair of rollers mounted on said dolly means adjacent the front edge of said bottom wall means and a further roller mounted on said bottom wall means adjacent the rear edge thereof; and chute means swingably mounted on said dolly means when same is in said first position for permitting waste to be deposited into the bag, said chute means being swingable between a substantially closed position wherein same is disposed substantially coextensive with the front side of said housing means and an open position wherein same projects outwardly and upwardly from the front side of said housing means for permitting waste to be deposited into said bag, said chute means having means associated with the lower edge thereof for defining a downwardly opening channel-shaped portion which is disposed in engagement with the front wall portion of said dolly means for hingedly supporting said chute means on said dolly means, said chute means being separable from both said dolly means and said housing means by lifting said channel-shaped portion upwardly out of engagement with the upper edge of the front wall portion.

11. In a waste compactor having housing means and a fluid pressure operated ram assembly mounted on said housing means and vertically movable downwardly for compacting waste within a movable waste receiving container, comprising:

said housing means including a plurality of walls defining a substantially closed housing having a vertically extending compartment in the interior thereof, said walls defining an access opening communicating with at least the lower part of said compartment;

said ram assembly being disposed in the upper portion of said compartment and having a portion thereof fixedly connected to said housing;

removable dolly means coacting with the lower end of said housing and including a front wall portion for closing at least a part of said access opening, said dolly means being rollingly movable between a first position wherein the dolly means coacts with the housing so that the front wall portion at least partially closes the access opening and a second position wherein the dolly means is laterally displaced from said first position and is disconnected from the housing;

said dolly means including substantially horizontally extending bottom wall means fixedly connected to said front wall portion and being removably mounted on said housing adjacent the lower portion of said compartment when said dolly means is in said first position, said bottom wall means being spaced downwardly from said ram assembly when said dolly means is in said first position;

waste receiving means removably positioned and supported on said dolly means for permitting waste to be deposited and compacted therein, said waste receiving means being supported on said bottom wall means and projecting upwardly therefrom in an upright free-standing manner, the upper edge of said waste receiving means being spaced downward from the upper edge of said front wall portion;

chute means mounted on said housing means at an elevation between the upper and lower ends thereof for permitting waste to be deposited into said waste receiving means when said dolly means is disposed in said first positions, said chute means being positioned directly above said front wall portion of said dolly means and projecting upwardly and outwardly from the front side of said housing for permitting waste to be deposited into said waste receiving means; and guide rail means fixed to said housing to assist in guiding waste into said waste receiving means, said guide rail means including a horizontally elongated guide rail fixed to the inner surface of each of the sidewalls and the rear wall of said housing, said guide rails being disposed substantially within a common horizontal plane which is located below said chute means but closely adjacent the upper edge of said waste receiving means, said guide rails projecting inwardly into said compartment so as to overlie the upper edge of said waste receiving means, each of said guide rails having an upper surface thereon which slopes inwardly and downwardly away from the respective housing wall to deflect the trash inwardly for deposit into the waste receiving means.

* * * * *

UNITED STATES PATENT AND TRADEMARK OFFICE

CERTIFICATE OF CORRECTION

PATENT NO. : 3 945 314

DATED : March 23, 1976

INVENTOR(S) : Ransom J. Hennells

It is certified that error appears in the above-identified patent and that said Letters Patent are hereby corrected as shown below:

Column 11, line 29; change "tubelike means" to ---tubelike assembly---.

Column 11, line 31; change "ram assembly" to ---ram means---.

Column 12, line 33; after "position" insert - comma ---,---.

Column 12, line 51; change "self sup-porting" to ---self-supporting---.

Column 13, line 15; Begin a new paragraph with "said stop means including".

Column 14, line 32; change "downward" to ---downwardly---.

Signed and Sealed this

Sixth Day of July 1976

[SEAL]

*Attest:*

RUTH C. MASON
*Attesting Officer*

C. MARSHALL DANN
*Commissioner of Patents and Trademarks*